United States Patent [19]

Edmonds et al.

[11] 4,305,766

[45] Dec. 15, 1981

[54] GELLED AQUEOUS SLURRY EXPLOSIVES CONTAINING GAS BUBBLES

[75] Inventors: Anthony C. F. Edmonds, St. Hilaire; Jitka Kirchnerova, Montreal; Terrence C. Matts, Mont St. Hilaire; Joseph R. J. Pare, Mont Laurier, all of Canada

[73] Assignee: C-I-L Inc., Montreal, Canada

[21] Appl. No.: 89,531

[22] Filed: Oct. 29, 1979

[30] Foreign Application Priority Data

Nov. 8, 1978 [CA] Canada ..... 316002

[51] Int. Cl.[3] ..... C06B 45/00

[52] U.S. Cl. ..... 149/2; 149/55; 149/60; 149/61

[58] Field of Search ..... 149/2, 2 F, 60, 55, 149/61, 47; 252/350

[56] References Cited

U.S. PATENT DOCUMENTS

| | | | |
|---|---|---|---|
| 3,390,031 | 6/1968 | Albert | 149/62 |
| 3,442,729 | 5/1969 | Knight | 149/60 |
| 3,660,181 | 5/1972 | Clay et al. | 149/2 F |
| 3,886,010 | 5/1975 | Thornley et al. | 149/60 |
| 4,134,780 | 1/1979 | Barnett | 149/60 |

*Primary Examiner*—Edward A. Miller

*Attorney, Agent, or Firm*—Donald G. Ballantyne

[57] ABSTRACT

An improved method of gassing an aqueous slurry explosive composition with an inorganic nitrite gassing agent is provided. The method makes use of a thiocyanate ion-containing material in the composition as a gassing accelerator. The presence of the thiocyanate ion produces improved rate and quantity of gas generation even under low temperature where gas generation is normally retarded.

5 Claims, No Drawings

GELLED AQUEOUS SLURRY EXPLOSIVES CONTAINING GAS BUBBLES

This invention relates to an improved method of gassing an aqueous slurry explosive composition employing nitrite salts as a gas-generating agent. In particular, the invention provides a means whereby gas may be efficiently generated from nitrite salts in a controlled manner even in conditions of reduced temperature.

The advantages of incorporating gas in aqueous slurry explosives by means of gassing agents or by the addition of gas-containing material for density and sensitivity control are now well known. As representative, see, for example, U.S. Pat. No. 3,288,661 (Swisstack), U.S. Pat. No. 3,338,165 (Minnick), U.S. Pat. No. 3,390,031 (Albert), and U.S. Pat. No. 3,390,032 (Albert et al.).

In accordance with the present invention, the gassing efficiency and productivity of nitrite salts can be substantially improved by combining with a nitrite salt, a gassing accelerator comprising the thiocyanate ion $SCN^-$. The present invention also provides a means of further enhancing the accelerating effect of the thiocyanate ion by combining with the thiocyanate ion a material containing a primary amino group chosen for a suitable combination of low basicity and high nucleophilicity selected from the classes of unsubstituted or substituted primary alkyl amines, unsubstituted aryl amines, or mixtures of these.

It is postulated that the action of the thiocyanate as a gassing accelerator in an aqueous nitrite solution results, first, in an equilibrium condition involving nitrous acid, thiocyanate ion and nitrosylthiocyanate as indicated below:

$$H^+ + SCN^- + HONO \rightleftharpoons NOSCN + H_2O$$

This equilibrium provides a species NOSCN which is more active than the nitrite or nitrous acid and with which electrophilic attack can take place on any free base present (for example, ammonia from ammonium ions in solution)

$$RH_2N: + NOSCN \rightarrow RNH_2^{\oplus}—NO + SCN^-$$

The nitrosylamine, $RNH_2^{\oplus}$—NO so formed rapidly collapses to produce nitrogen, water and $R^{\oplus}$. By taking advantage of this phenomenon, gas generation from nitrite salts in aqueous explosive slurries may be utilized, even under conditions which militate agains gas generation, for example, low temperatures and/or high pH where nitrites normally fail to provide adequate amounts of gas at rapid enough rates for density-control purposes. Applicant is not to be bound by the theory postulated but offers it as a rationale for the results obtained as shown hereinbelow.

Examples of the invention are provided below wherein inorganic nitrites in combination with the gassing accelerators as described demonstrate improvements over the use of the nitrites alone.

EXAMPLE 1

As representative precursors to aqueous slurry explosives, salt solutions devoid of sensitizer/fuel or thickener were prepared comprising 50% by weight of ammonium nitrate, 20% by weight of either sodium nitrate or calcium nitrate, 0.5% by weight of zinc nitrate and water to 100% by weight. The solution had an initial pH of 4.1 (±0.1) and was maintained at a temperature of 50° C. To this system was added an amount of 0.06% by weight of sodium nitrite alone and in admixture with approximately 0.06% by weight of thiocyanate ion (as sodium thiocyanate). The evolved gas, mainly nitrogen, was allowed to escape from the aqueous solution and was collected and measured at intervals, the time required to produce one-half the total evolved gas (the half-life time) being recorded. The results are shown in Table I, below:

TABLE I

| | Half-life time of gas evolution | |
|---|---|---|
| Accelerator | AN/Sodium nitrate solution | AN/Calcium nitrate solution |
| Sodium thiocyanate | 16 min. | 11 min. |
| None | 42 min. | 48 min. |

As evident from the results recorded in Table I, the use of a thiocyanate accelerator substantially increased the rate at which gas was generated in both representative solutions.

EXAMPLE 2

Two compositions similar to those of Example 1 were prepared except that 0.14% by weight of potassium nitrite was employed as the gassing agent in both compositions and 0.11% by weight of ammonium thiocyanate was employed in one composition only as the gassing accelerator. The composition devoid of ammonium thiocyanate showed a gassing half-life time at 50° C. of 10.5 minutes while the composition containing the thiocyanate accelerator at the same temperature had a gassing half-life time of 90 seconds.

EXAMPLE 3

An aqueous slurry explosive composition of the type suitable for use in large diameter borehole charges was prepared according to the following formulation; the amounts shown being expressed as percent by weight:

| | |
|---|---|
| Water | 7.53% |
| Ammonium nitrate | (up to 100%) |
| Sodium nitrate | 9.33% |
| Ethanolamine nitrate | 4.24% |
| Zinc nitrate | 0.19% |
| Fuel oil | 6.00% |
| Sodium lignosulphonate | 0.50% |
| Guar gum | 0.40% |
| Calcium nitrate | 20.00% |
| Sodium nitrite | 0.08% |
| Sodium dichromate (crosslinker) | 0.04% |

One portion of the above composition contained additionally an amount of 0.2% by weight of sodium thiocyanate accelerator and the gas generation rate was recorded. This accelerated gas evolution was compared with that of the same composition devoid of thiocyanate accelerator, the results being recorded in Table II, below in terms of reduced specific gravity of the explosive composition.

TABLE II

| | | With thiocyanate | Without thiocyanate |
|---|---|---|---|
| Temperature of composition | | 38° C. | 38° C. |
| Specific gravity of composition | start | 1.37 | 1.38 |

TABLE II-continued

| | | With thio-cyanate | Without thio-cyanate |
|---|---|---|---|
| Specific gravity of composition | 1 min. | 1.12 | — |
| Specific gravity of composition | 2 min. | 1.05 | — |
| Specific gravity of composition | 3 min. | 1.02 | — |
| Specific gravity of composition | 5 min. | — | 1.32 |
| Specific gravity of composition | 10 min. | 0.95 | 1.21 |
| Specific gravity of composition | 15 min. | — | 1.16 |

The results in Table II demonstrate the increased rate of gas evolution as indicated by specific gravity reduction in the explosive composition containing thiocyanate. It has also been observed that the composition containing the thiocyanate accelerator showed a somewhat reduced viscosity which resulted in improved processability.

EXAMPLE 4

A series of blasting agents with and without the thiocyanate accelerator were prepared comprising the ingredients shown below in Table III. The rate of gassing and other characteristics of the compositions were measured and are recorded in Table III. The amounts of ingredients shown in Table III are expressed as percent by weight of the total composition.

TABLE III

| Ingredients | Mix A | Mix B | Mix C | Mix D |
|---|---|---|---|---|
| Water | 9.00 | 9.00 | 13.00 | 13.00 |
| Ammonium nitrate | 70.97 | 70.97 | 62.50 | 62.50 |
| Calcium nitrate | 13.00 | 13.00 | — | — |
| Sodium nitrate | — | — | 13.30 | 13.30 |
| Zinc nitrate | 0.30 | 0.30 | 0.30 | 0.30 |
| Sodium thiocyanate | 0.13 | — | 0.15 | — |
| Guar gum | 0.35 | 0.35 | 0.40 | 0.40 |
| Ethylene glycol | 0.70 | 0.70 | 0.60 | 0.60 |
| Sodium lignosulfonate | 0.35 | 0.25 | 0.30 | 0.30 |
| Fuel oil | 5.20 | 5.20 | 3.50 | 3.50 |
| Sulphur | — | — | 6.00 | 6.00 |
| Sodium nitrate | 0.12 | 0.12 | 0.30 | 0.30 |
| Potassium pyroantimonate (crosslinker) | 0.05 | 0.05 | 0.50 | 0.05 |
| pH | 4.0 | 4.0 | 3.9 | 3.9 |
| Temperature °C. | 57 | 60 | 55 | 55 |
| Initial specific gravity | 1.32 | 1.29 | 1.27 | 1.25 |
| Final specific gravity | 0.90 | 0.91 | 0.58 | 0.70 |
| Gassing time (min.) | 14 | 150 | 15 | 300 |
| Half life gassing time | 5 | 40 | 5.5 | 20 |

From Table III it will be observed that the rates of gas generation, as indicated both by the final specific gravity and the half-life gassing time, for Mix A and Mix C containing thiocyanate were superior to the rates for Mix B and Mix D which were devoid of thiocyanate.

EXAMPLE 5

An aqueous slurry explosive composition of the type containing an organic sensitizer as a separate solid phase was prepared according to the following formulation, the amounts shown being expressed as total weight in grams:

| | |
|---|---|
| Water | 490 grams |
| Ammonium nitrate | 2495 grams |
| Calcium nitrate | 1740 grams |
| Sodium nitrate | 250 grams |
| Zinc nitrate | 25 grams |
| Potassium pyroantimonate (crosslinker) | 4 grams |
| Guar gum | 30 grams |
| Ethylene glycol | 50 grams |
| Sodium lignosulphonate | 25 grams |
| DNT | 720 grams |
| TNT (pellets) | 485 grams |
| Sodium nitrite | 15 grams |

The composition was prepared by mixing together the ammonium nitrate, calcium nitrate, sodium nitrate, zinc nitrate and water at 60° C. followed by the addition of lignosulphonate, guar gum, glycol and pyroantimonate. The DNT and TNT, comprising the organic sensitizer, were combined together and blended into the mixture. The sodium nitrite gassing agent was added last. To one portion of the composition an amount of 14 g of sodium thiocyanate accelerator was added and the final density of this composition was compared with the density of the thiocyanate-free composition. It was found that a density of 1.20 could be achieved in the thiocyanate-free composition only by maintaining the composition at an elevated temperature of 35° C. during overnight storage. The thiocyanate-containing composition was produced to the same density of 1.20 at ambient temperatures without difficulty.

EXAMPLE 6

To demonstrate an added-on enhancing or synergistic effect of the use of an amino-containing material in combination with the thiocyanate ion in increasing the gassing productivity of sodium nitrite, a series of salt solutions (precursors of explosive slurries) were prepared. These solutions comprised 50% by weight of ammonium nitrate, 20% by weight of sodium nitrate, 0.5% by weight of zinc nitrate and water to 100% by weight. The solution had an initial pH of 4.1 (±0.1) and was maintained at 40° C. To separate portions of the solution, 0.06% by weight of sodium nitrite gassing agent alone and in combination with approximately 0.06% by weight of sodium thiocyanate and amino-group-containing materials as shown in Table IV below. The half time of gas evolution was measured, the results being recorded in Table IV.

TABLE IV

| Accelerator system | Molar ratios | Half time of gas evolution (min.) |
|---|---|---|
| 1. No accelerator | — | 60 |
| 2. Sodium thiocyanate/ sodium nitrite | 2/1 | 14 |
| 3. Ethanolamine nitrate/ sodium thiocyanate/ sodium nitrite | 2/2/1 | 11 |
| 4. Acrylamide/sodium thiocyanate/sodium nitrite | 2/2/1 | 13 |
| 5. Urea/sodium thiocyanate/ sodium nitrite | 2/2/1 | 13.5 |

From Table IV it will be observed that when an amino-group-containing material is used in combination with the thiocyanate accelerator, an improvement in the rate of gas generation from sodium nitrite is obtained.

We claim:

1. In a slurry explosive composition comprising essentially water, inorganic oxygen-supplying salt and fuel ingredients and containing an inorganic nitrite as a gas generant, the improvement comprising the presence therein of thiocyanate ion-containing material as a gas generating accelerator.

2. A composition as claimed in claim 1 also containing as an accelerator enhancer a water solution soluble substituted amine or amide.

3. A composition as claimed in claim 1 wherein the inorganic nitrite gas generant is selected from the group of sodium nitrite and potassium nitrite or mixtures of these.

4. A composition as claimed in claim 1 wherein the thiocyanate ion-containing material is selected from the group of sodium thiocyanate and ammonium thiocyanate or mixtures of these.

5. A composition as claimed in claim 2 wherein the accelerator enhancer is selected from ethanolamine, acrylamide or urea or mixtures of these.

* * * * *